US008315126B2

(12) United States Patent
Someya

(10) Patent No.: US 8,315,126 B2
(45) Date of Patent: Nov. 20, 2012

(54) ANTENNA DEVICE, RECEPTION DEVICE, AND RADIO WAVE TIMEPIECE

(75) Inventor: Kaoru Someya, Kiyose (JP)

(73) Assignee: Casio Computer Co., Ltd., Tokyo (JP)

( * ) Notice: Subject to any disclaimer, the term of this patent is extended or adjusted under 35 U.S.C. 154(b) by 542 days.

(21) Appl. No.: 12/611,186

(22) Filed: Nov. 3, 2009

(65) Prior Publication Data

US 2010/0124151 A1 May 20, 2010

(30) Foreign Application Priority Data

Nov. 17, 2008 (JP) ..... 2008-293053
Dec. 3, 2008 (JP) ..... 2008-308482

(51) Int. Cl.
*G04C 11/02* (2006.01)

(52) U.S. Cl. ..... 368/47; 455/269

(58) Field of Classification Search ..... 368/47; 310/300; 455/269
See application file for complete search history.

(56) References Cited

U.S. PATENT DOCUMENTS 6,061,550 A 5/2000 Tanaka et al.
7,853,223 B2 * 12/2010 Han et al. ..... 455/130
7,863,799 B1 * 1/2011 Godil ..... 310/309
2003/0184477 A1 10/2003 Shafai et al.
2005/0057399 A1 3/2005 Kipnis et al.
2005/0062653 A1 3/2005 Cetiner et al.
2007/0097796 A1 5/2007 Someya et al.
2007/0200648 A1 8/2007 Reichenbach et al.
2011/0102871 A1 * 5/2011 Godil ..... 359/200.6

FOREIGN PATENT DOCUMENTS

EP 0 767 540 A 4/1997
JP 2000-188558 A 7/2000
JP 2005-201775 A 7/2005
JP 2007-124335 A 5/2007

OTHER PUBLICATIONS

European Search Report and Written Opinion dated Dec. 8, 2009 (in English) issued in a counterpart European Application No. 09174157.9.

* cited by examiner

*Primary Examiner* — Sean Kayes
(74) *Attorney, Agent, or Firm* — Holtz, Holtz, Goodman & Chick, PC

(57) ABSTRACT

An antenna device includes an oscillating body capable of oscillating at a predetermined natural frequency, and being displaceable by external magnetic field, and a converter for converting motion of the oscillating body to an electrical signal. When a radio wave signal of a frequency band at which the oscillating body resonates comes, the oscillating body resonates with a magnetic field component of the radio wave signal, and the converter converts the motion to the electrical signal, whereby an electrical signal corresponding to the radio wave signal is outputted.

20 Claims, 7 Drawing Sheets

ANTENNA DEVICE, RECEPTION DEVICE, AND RADIO WAVE TIMEPIECE

CROSS-REFERENCE TO RELATED APPLICATIONS

This application is based on and claims the benefit of priority from the prior Japanese Patent Application No. 2008-293053 filed on Nov. 17, 2008 and the prior Japanese Patent Application No. 2008-308482 filed on Dec. 3, 2008 including specification, claims, drawings and summary, the entire contents of which are incorporated herein by reference.

BACKGROUND OF THE INVENTION

1. Field of the Invention

The present invention relates to an antenna device and a reception device for receiving a radio wave signal, and a radio wave timepiece for receiving a standard radio wave containing a time code.

2. Description of Related Art

In general, various antennas such as a linear antenna, a wire-wound bar antenna, a planar antenna, etc. are known. A wire-wound bar antenna is used for a radio wave timepiece or the like receiving a standard radio wave because it is necessary to mount an antenna in a small timepiece body.

General antennas such as the linear antenna, the wire-wound bar antenna, etc. are restricted in miniaturization. That is because the linear antenna is required to have a length which is matched with a reception frequency band, and the wire-wound bar antenna is lowered in effective Q value (the sharpness of the resonance peak) and sensitivity due to an effect of demagnetizing field when the core thereof is short.

Furthermore, because the wire-would bar antenna, when a metal element are close to it, induces an eddy current there due to variation of a magnetic flux occurring in the winding coil and the core, and the sensitivity of the antenna is remarkably lowered due to the induced eddy current.

SUMMARY OF THE INVENTION

According to an aspect of the present invention, there is provided an antenna device comprising an oscillating body capable of oscillating at a predetermined natural frequency, and displaceable by external magnetic field; and a converter for converting motion of the oscillating body to an electrical signal, wherein when a radio wave signal of a frequency band at which the oscillating body resonates comes, the oscillating body resonates with a magnetic field component of the radio wave signal, and the converter converts the motion to the electrical signal, whereby an electrical signal corresponding to the radio wave signal is outputted.

DESCRIPTION OF THE PREFERRED EMBODIMENT

Embodiments of the present invention will be described with reference to the drawings.

[First Embodiment]

Figure 1:
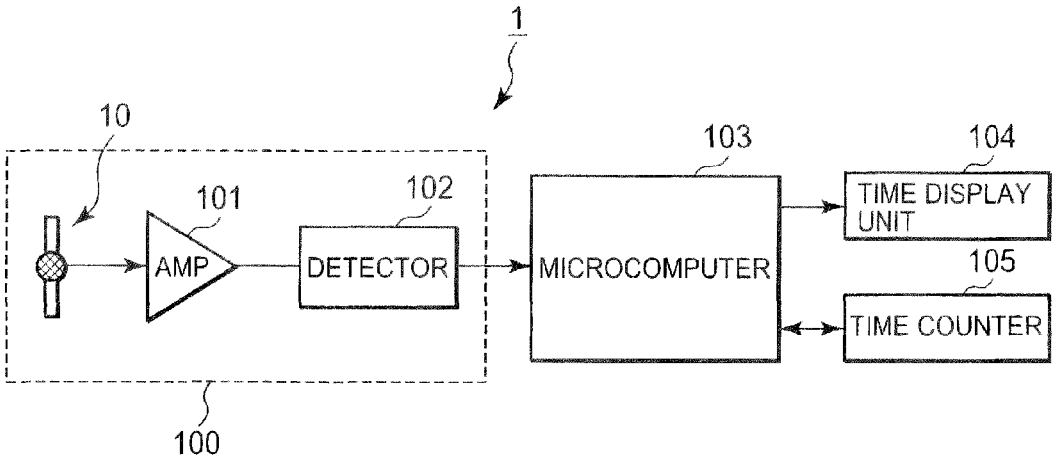
FIG. 1 is a diagram showing the overall construction of a radio wave timepiece according to a first embodiment of the present invention.

FIG. 1 is a diagram showing the overall construction of a radio wave timepiece according to a first embodiment of the present invention.

The radio wave timepiece 1 according to an embodiment of the present invention comprises an MEMS antenna 10 as an antenna device for receiving a standard radio wave containing a time code, an amplifier 101 for amplifying a reception signal, a detector 102 as a demodulator for extracting the time code from the reception signal, a microcomputer 103 for performing the overall control of timepiece 1, a time display unit 104 for displaying time information, a time counter 105 for counting the time, etc. In this embodiment a radio wave receiver 100 as a reception device is constructed by the MEMS antenna 10, the amplifier 101, and the detector 102.

The radio wave receiver 100 containing the MEMS antenna 10 is formed on, for example, one semiconductor substrate. It also may be that the radio wave receiver 100, the microcomputer 103 and the time counter 105 formed on one semiconductor substrate.

The radio wave timepiece 1 of this embodiment operates as follows.

First, the microcomputer 103 updates the output to the time display unit 104 in synchronism with time-count data of the time counter 105 to thereby execute the display control of the present time. Furthermore, the microcomputer 103 executes a radio wave reception control program when a predetermined time comes, whereby the radio wave receiver 100 receives a standard radio wave transmitted through a carrier wave of a predetermined frequency band (for example, 60 kHz) and detects the time code. The microcomputer 103 inputs the detected time code and determines an accurate present time from the time code. When the time counted by the time counter 105 is displaced from the present time determined on the basis of the time code, the microcomputer 103 automatically corrects this displacement, therefore the accurate time is displayed at all times.

Figure 2:
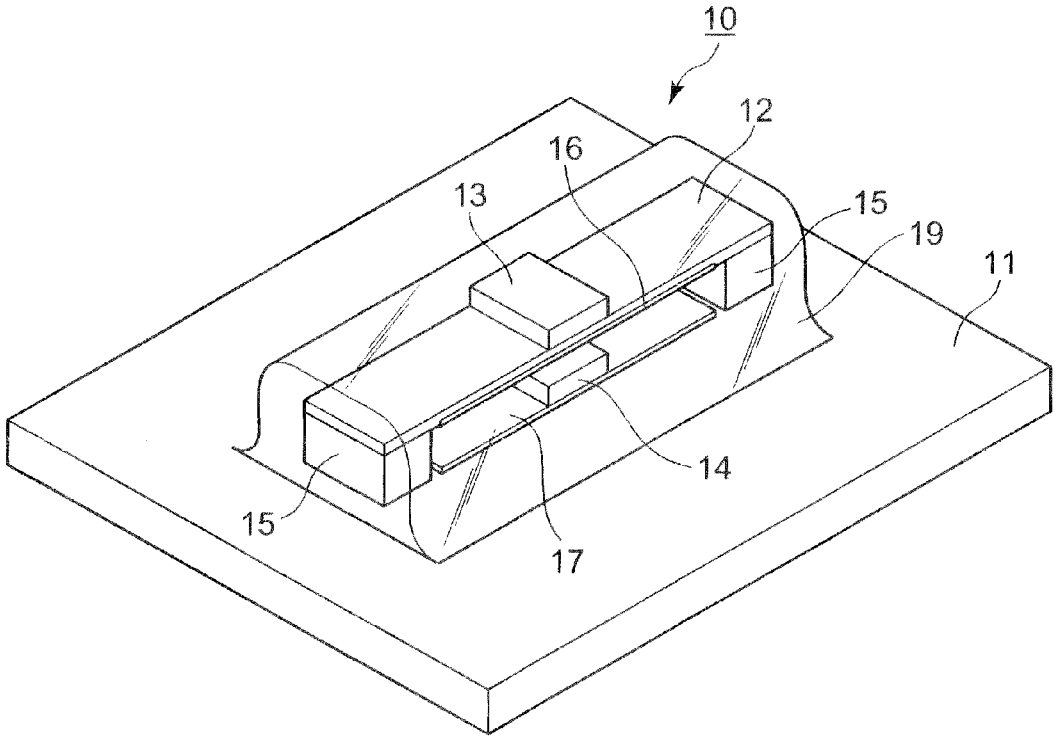
FIG. 2 is a perspective view showing a first embodiment of the MEMS antenna according to the present invention.
Figure 3:
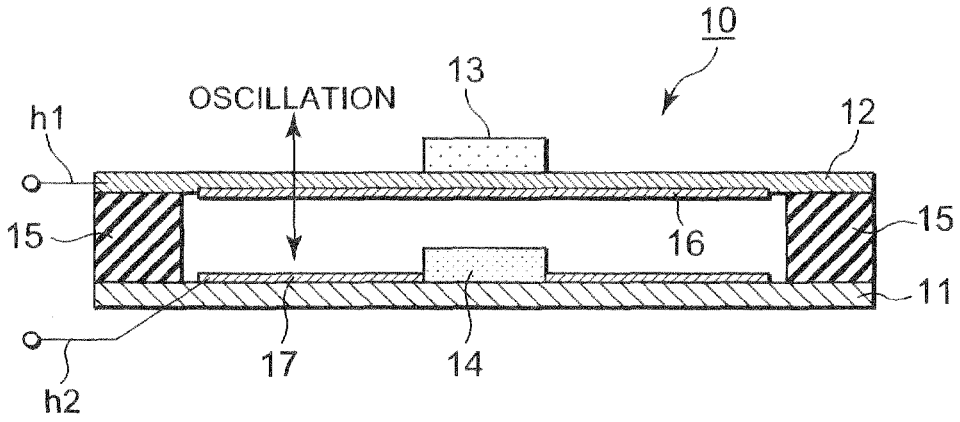
FIG. 3 is a longitudinally sectional view of the MEMS antenna of the first embodiment.
Figure 4:
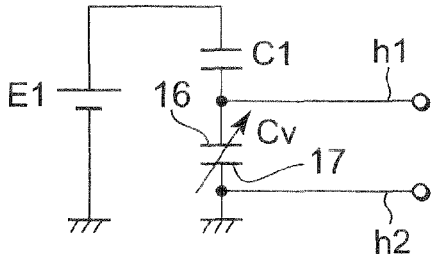
FIG. 4 is a circuit diagram showing an electrical connection structure of the MEMS antenna of the first embodiment.

FIG. 2 is a perspective view showing a first embodiment of the MEMS antenna according to the present invention, FIG. 3 is a longitudinally sectional view of the MEMS antenna of the first embodiment, and FIG. 4 is a circuit diagram showing an electrical connection structure of the MEMS antenna of the first embodiment.

The MEMS antenna 10 of the first embodiment is an extremely small antenna (for example, several millimeters or less, or of a micron-order size) which is formed on a semiconductor substrate by using the MEMS (Micro Electro Mechanical Systems) fabrication technique, and it receives a magnetic field component of a radio wave signal and converts it to an electrical signal.

As shown in FIGS. 2 and 3, the MEMS antenna 10 comprises a beam 12 formed on a substrate 11, spacers 5 which are composed of insulating material and fix a part of the beam 12, a magnetic member 13 formed on a movable range of the beam 12, a permanent magnet 14 fixed below the beam 12, a planar electrode (first electrode) 16 which is formed on the beam 12 or unified with the beam 12, a planar electrode 17 (second electrode) formed at a site on the substrate 11 which faces the beam 12, etc. A space is provided around the beam 12 and the surrounding of the beam 12 is sealed with resin 19 or the like under the state that the beam 12 is displaceable in the vertical direction.

In this embodiment, an oscillating body is constructed by the beam 12, the magnetic member 13. A converter for converting the displacement of the beam 12 to an electrical signal is constructed by electrodes 16 and 17.

The beam 12 is formed of silicon, for example. The beam 12 is shaped like a board. The longitudinal direction of the beam 12 along the substrate 11, a part of the beam 12 (both the end portions of the beam 12) is fixed to the substrate 11 through the spacers 15, and the other site of the beam 12 is kept floated above the substrate 11 through a gap. The gap at the lower side of the beam can be formed by etching a sacrificial layer or the like. This unfixed site is capable of oscillating vertically with respect to the substrate 11.

The natural frequency of the beam 12 can be set to a desired frequency by adjusting the length and thickness of the beam 12. In this embodiment, the natural frequency is set to be equal to the frequency of the carrier wave of the standard radio wave signal (for example, 60 kHz).

Temperature compensation for the oscillation characteristic as described above can be performed by properly combining the beam 12 with SiGe (silicon germanium) or other materials.

The planar electrode 16 formed on the beam 12 and the planar electrode 17 formed on the substrate 11 face each other to thereby construct an electrical capacitor. These electrodes are formed by vapor deposition of metal material, for example. It is preferable that the metal material is aluminum or the like which is not magnetized. In place of formation of the electrode 16 on the beam 12, the beam itself may be also constructed as an electrode by doping or the like the material of the beam 12 in order to have electrical conductivity.

Wires h1 and h2 are connected to the electrodes 16 and 17 through a normal semiconductor fabrication process, and the wires h1 and h2 are led out onto the substrate 11. In FIG. 3, the wires h1 and h2 are omitted from the illustration. However, the wire h2 on the substrate 11 is actually directly led out to the outside of the MEMS antenna 10 on the substrate 11, and the wire h1 at the beam 16 is led through a contact hole formed in the spacer 15 onto the substrate 11, and then led out to the outside of the MEMS antenna 10 on the substrate 11.

The spacers 15 are formed of silicon oxide film ($SiO_2$) to have an insulating property, for example.

The permanent magnet 14 on the substrate 11 applies magnetic force to the magnetic member 13 of the beam 12. A block of ferromagnetic material is formed by thin-film deposition of ferromagnetic material based on sputtering and then strong magnetic field is applied to the block of the ferromagnetic material to magnetize the ferromagnetic material in a specific direction, thereby forming the permanent magnet 14 on the substrate 11.

The magnetic member 13 on the beam 12 receives the magnetic field component of the radio wave signal to be magnetized, and thus it generates repulsive force or attractive force to the permanent magnet 14 so that the beam 12 is displaced. The magnetic member 13 may be formed of thin-film deposition of magnetic material (for example, soft magnetic material) based on sputtering, for example.

As shown in FIG. 4, the electrodes 16 and 17 of the MEMS antenna 10 constitute a variable capacitor Cv which varies in capacitance due to the displacement of the beam 12. A capacitance element C1 is connected onto the semiconductor substrate in series with the variable capacitor Cv, and a voltage E1 is applied to the series circuit of these elements. According to this construction, the beam 12 is displaced, and the capacitance value of the variable capacitor Cv is varied, whereby the electrical signal (voltage) corresponding to the displacement of the beam 12 is outputted between the terminals of the variable capacitor Cv.

The same action can be also obtained by serially connecting a resistance element to the variable capacitor Cv in place of the capacitance element C1 of FIG. 4.

Next, the operation of the MEMS antenna 10 and the radio wave receiver 100 will be described.

According to the MEMS antenna 10 of this embodiment, when the standard radio wave having the frequency band (for example, 60 kH) corresponding to the natural frequency of the beam 12 comes, the magnetic field component of this radio wave signal exercises acting force on the beam 12 so that the beam 12 resonates, and thus the beam 12 is displaced in accordance with the magnitude of the magnetic field component of the radio wave signal.

The displacement of the beam 12 causes capacitance variation of the variable capacitor Cv, and the electrical signal corresponding to this capacitance variation is outputted from the MEMS antenna 10 to the amplifier 101. This electrical signal corresponds to an electrical signal substantially directly converted from the coming standard radio wave. This electrical signal is amplified by the amplifier 101, and then sent to the detector 102 to detect the time code.

On the other hand, when a radio wave having a frequency band out of the natural frequency of the beam comes, the magnetic field component of this radio wave signal exercises acting force on the beam 12, however, the beam 12 oscillates at a frequency other than the natural frequency of the beam 12, so that this acting force is absorbed or offset in the beam 12 and thus the beam 12 does not oscillate. Accordingly, the capacitance variation of the variable capacitor Cv does not occur, and the signal outputted from the MEMS antenna 10 is substantially equal to zero.

Furthermore, when a mixture of the standard radio wave and a radio wave having another frequency come, both the radio waves act on the beam 12 so that the actions of both the radio waves on the beam are overlapped with each other. Therefore, the radio wave of the frequency band out of the natural frequency of the beam 12 is removed, and only the standard radio wave can be extracted and received by the MEMS antenna 10, so that only the signal of the standard radio wave are sent to the amplifier 101 and the detector 102.

Figure 5:
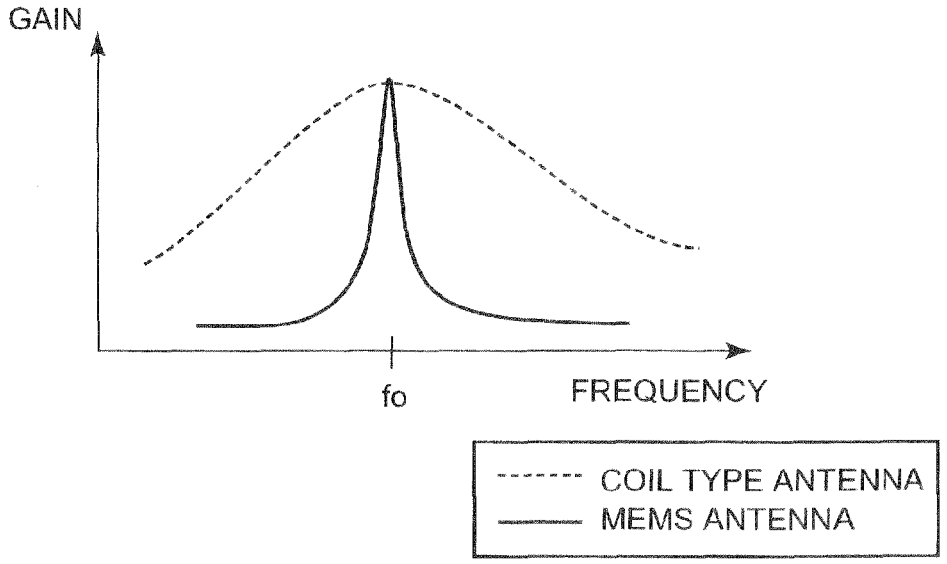
FIG. 5 is a graph showing the frequency characteristics of the MEMS antenna and the conventional coil type antenna.

FIG. 5 is a graph showing the frequency characteristics of the MEMS antenna and the conventional coil type antenna.

There is obtained such a frequency characteristic that the oscillating body formed by the MEMS fabrication technique resonates largely at only a narrow-band natural frequency range. Therefore, according to the thus-constructed MEMS antenna 10, there can be obtained a characteristic that only a radio wave having a specific frequency f0 is received with a very high Q value and thus radio waves having frequencies out of the specific frequency f0 can be greatly removed as indicated by a solid line of FIG. 5. A dashed line of FIG. 5 represents the frequency characteristic of a coil type antenna for comparison. As is apparent from the comparison between the characteristic lines indicated by the solid line and the dashed line of FIG. 5, the Q value of the reception gain of the MEMS antenna is very higher than that of the coil type antenna.

As described above, according to the MEMS antenna 10 of this embodiment, the remarkable miniaturization of the antenna can be performed by using the MEMS fabrication technique. Furthermore, the MEMS antenna 10 itself can receive only the radio wave signal having the specific frequency band like a narrow-band filter and cut the input of the radio waves having the frequencies other than the specific frequency band, so that any out-of-band signal input can be removed at the reception stage of the radio waves. Accordingly, there does not occur any trouble that the operation of the amplification stage is saturated by the input of an out-of-band radio wave and thus the reception sensitivity is lowered by this saturation.

Furthermore, in the coil type antenna, relatively large variation of magnetic flux occurs in a coil and a core in connection with reception of a radio wave, and thus an eddy current occurs in metal elements around the coil and the core. Therefore, there is a problem that the reception sensitivity is greatly lowered due to occurrence of this eddy current. However, in the MEMS antenna 10, such an eddy current is prevented from occurring, and thus the reception sensitivity is not lowered. Accordingly, even if some metal element is located around, high reception sensitivity can be implemented unless input of radio wave is not interrupted.

Furthermore, the MEMS antenna 10 adopts the construction that the magnetic member 13 is provided on the beam 12 and the permanent magnet 14 is provided below the beam 12 to oscillate the beam 12. Accordingly, the manufacturing process can be simplified and the manufacturing cost can be reduced. Furthermore, the permanent magnet 14 exercises the magnetic force on the magnetic member 13 of the beam 13, thereby magnifying the displacement of the beam 12 by the action of the magnetic field portion of the radio wave signal.

Furthermore, the planar electrodes 16 and 17 which face each other are formed on the beam 12 and the substrate 11 respectively, and the electrical signal corresponding to the displacement of the beam 12 is outputted by the variable capacitor Cv comprising the electrodes 16 and 17. Therefore, the displacement of the beam 12 can be surely converted to the electrical signal by the relatively simple construction.

Still furthermore, according to the radio wave receiver 100 of this embodiment, the MEMS antenna 10 itself has a narrow-band filter characteristic. Therefore, it is unnecessary to separately provide a narrow-band filter, and simplification of the circuit and reduction of the mount area can be performed.

Furthermore, according to the radio wave timepiece 1 of this embodiment, the radio wave receiver 100 can be designed in a remarkably compact size together with the MEMS antenna 10, and thus the antenna and the reception circuit can be mounted with an extra space in a small device such as a wrist watch body or the like. Furthermore, the MEMS antenna 10 does not induce the eddy current in the surrounding metal element unlike, the coil type antenna, and thus when it is mounted in a timepiece, an effect of increasing the degree of freedom of the location place of the antenna can be obtained.

[Second Embodiment]

Figure 6:
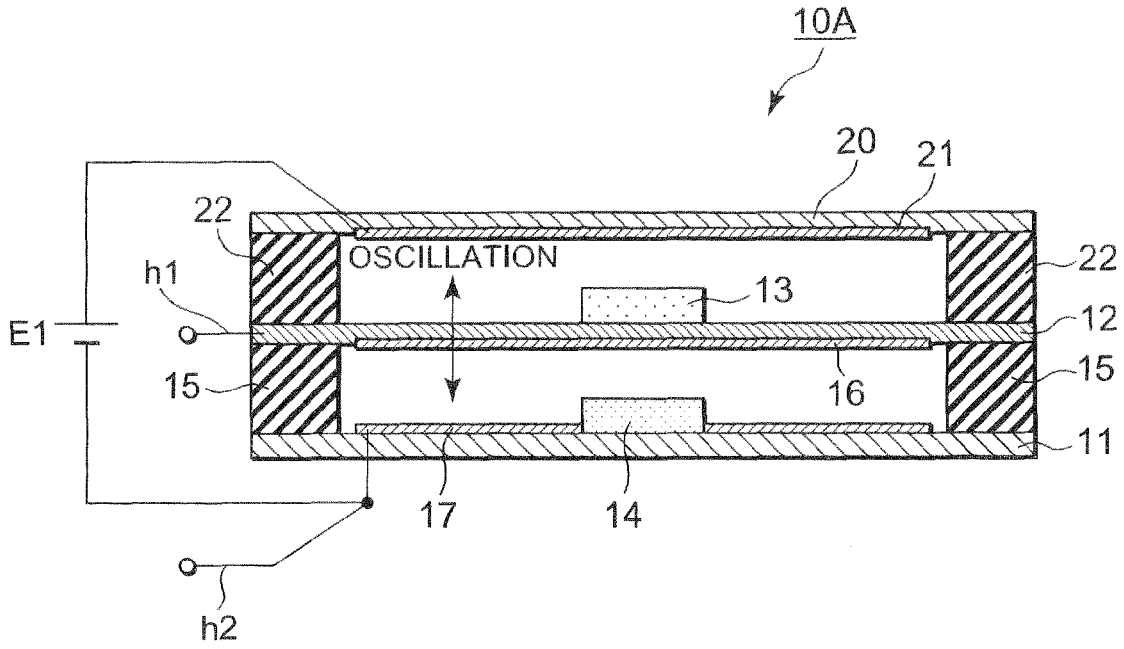
FIG. 6 is a longitudinally sectional view showing a second embodiment of the MEMS antenna according to the present invention.

FIG. 6 is a longitudinally sectional view showing a second embodiment of the MEMS antenna according to the present invention.

In the MEMS antenna 10A of the second embodiment, an electrode is also provided above the beam 12 (at the opposite side to the substrate 11) so that a relatively large electrical signal can be taken out from the MEMS antenna 10A. The basic construction of the second embodiment is the same as the first embodiment. The same constituent elements as the first embodiment are represented by the same reference numerals, and the description thereof is omitted.

In the MEMS antenna 10A of this embodiment, a board-like cover plate 20 is provided so as to cover the upper side of the beam 12, and a planar electrode (third electrode) 21 is formed on the cover plate 20. The cover plate 20 is formed so as to be floated from the beam 12 through spaces 22 so that the cover plate 20 does not disturb the free displacement of the beam 12.

The cover plate 20 can be formed of the same material as the beam 12 through the same fabrication process as the beam 12. Furthermore, the cover plate 20 is formed while the thickness thereof is increased or the hardness thereof is increased so that the cover plate 20 does not oscillate unlike the beam 12.

The electrode 21 can be formed of the same material as the electrode 16 of the beam 12 and through the same fabrication manner as the electrode 16 of the beam 12, and the spacers 22 can be formed of the same material as the spacers 15 for supporting the beam 12 and in the same fabrication manner as the spacers 15. The spacers 22 are located so as to be piled up on the spacers 15 supporting the beams 12, for example.

Figure 7:
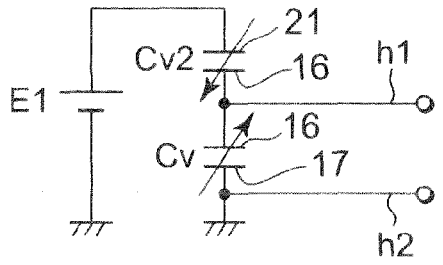
FIG. 7 is a circuit diagram showing the electrical connection construction of the MEMS antenna of the second embodiment.

FIG. 7 is a circuit diagram showing the electrical connection construction of the MEMS antenna of the second embodiment.

As shown in FIG. 7, the three electrodes 17, 16 and 21 constitute two variable capacitors Cv and Cv2, and the electrical capacitance of each of the variable capacitors Cv and Cv2 varies due to the displacement of the beam 12. In detail, one variable capacitor Cv is constructed by the electrode 16 on the beam 12 and the electrode 17 on the substrate 11, and the other variable capacitor Cv2 is constructed by the electrode 16 on the beam 12 and the electrode 21 on the cover plate 20. Furthermore, the two variable capacitors Cv and Cv2 are connected to each other in series, and a constant voltage E1 is applied to this series circuit.

In this construction, when the beam 12 is displaced, the capacitance values of the two variable capacitors Cv and Cv2 vary in the opposite directions to each other (i.e., the positive and negative directions), whereby the electrical signal corresponding to the displacement of the beam 12 is outputted between the terminals of the variable capacitor Cv. According to this construction, the amplitude of the output voltage can be increased to approximately double as compared with the circuit of the first embodiment shown in FIG. 4.

[First Modification of Arrangement Construction of Magnet]

Figure 8:
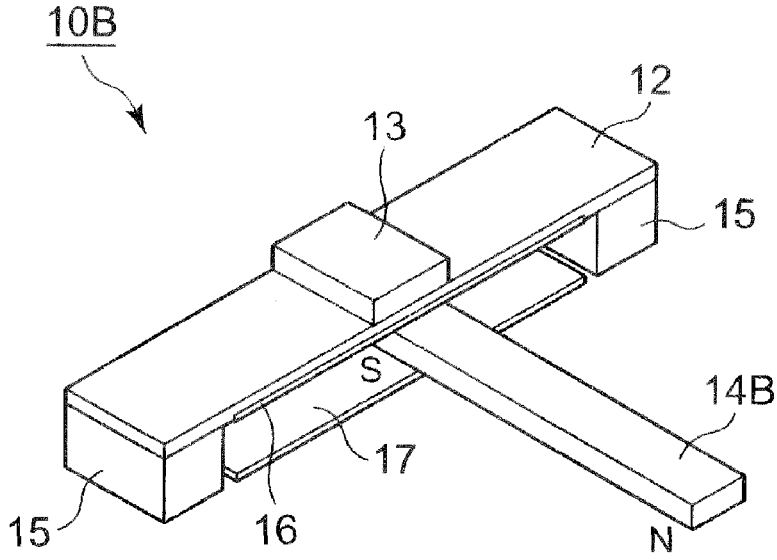
FIG. 8 is a perspective view showing a first modification of the arrangement construction of a magnet in the MEMS antenna.

FIG. 8 is a perspective view showing a first modification of the arrangement construction of a magnet in the MEMS antenna. The same constituent elements as the first embodiment are represented by the same reference numerals, and the description thereof is omitted.

The MEMS antenna 10B of this modification is an example of the construction that the magnitude of the magnetic force applying from the permanent magnet 14B to the magnetic member 13 is increased. As shown in FIG. 8, in the MEMS antenna 10B of this modification, the permanent magnet 14B is designed so that one side thereof is longer and the longitudinal direction of the permanent magnet 14B is set to intersect the longitudinal direction of the beam 12. One end of the permanent magnet 14B is located below the beam 12, and the other end is located to be far away from the beam 12. The permanent magnet 148 is magnetized so that magnetic poles appear at one end portion and the other end portion in the longitudinal direction of the permanent magnet 14B.

According to the construction of the permanent magnet 14B as described above, a magnetic flux occurs along a closed path in space from the one end portion to the other end portion of the permanent magnet 14B, and the magnetic flux along the closed path penetrates through the magnetic member 13 of the beam 12, therefore relatively large magnetic force can be applying from the permanent magnet 14B to the magnetic member 13.

[Second Modification of Arrangement Construction of Magnet]

Figure 9:
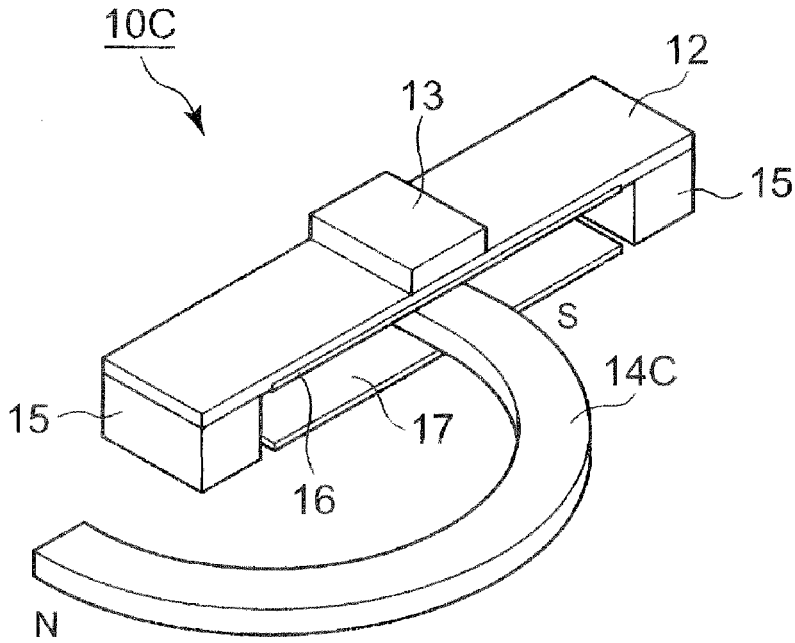
FIG. 9 is a perspective view showing a second modification of the arrangement construction of the magnet in the MEMS antenna.

FIG. 9 is a perspective view showing a second modification of the arrangement construction of the magnet in the MEMS antenna. The same constituent elements as the first embodiment are represented by the same reference numerals, and the description thereof is omitted.

In the MEMS antenna 10C of this modification, the permanent magnet 14C is designed so that one side thereof is longer and curved. One end of the permanent magnet 14C is located below the beam 12. The permanent magnet 14C extends from the one end thereof so as to temporarily get away from the beam 12, and then is turned so as to approach to the beam 12 again. The permanent magnet 14C is magnetized so that magnetic poles appear at both the one end portion and the other end portion along the longitudinal direction of the permanent magnet 14C.

According to the construction of the permanent magnet 14C as described above, a magnetic flux occurs along a closed path in space from the one end portion to the other end portion of the permanent magnet 14C, and the distance between the one end portion and the other end portion of the permanent magnet 14*c* is short. Therefore, a larger amount of magnetic flux penetrates through the magnetic member 13, and large magnetic force can be applied from the permanent magnet 14C to the magnetic member 13.

[Third Modification of Arrangement Construction of Magnet]

Figure 10:
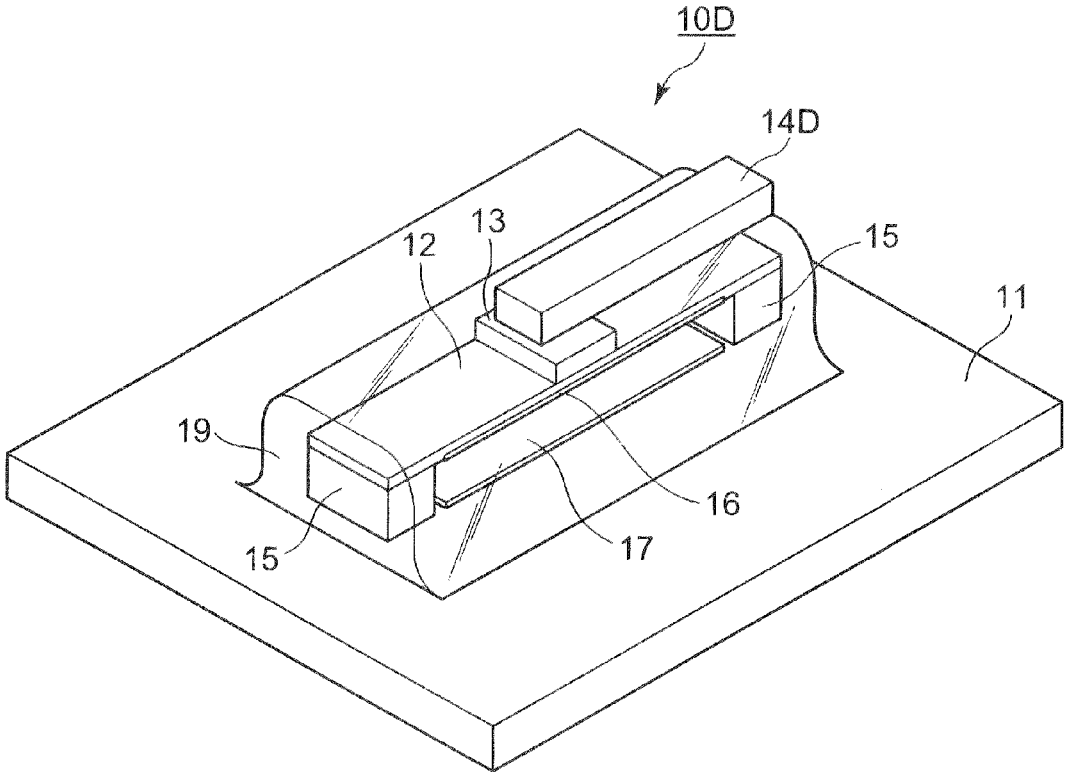
FIG. 10 is a perspective view of a third modification of the arrangement construction of the magnet in the MEMS antenna.
Figure 11:
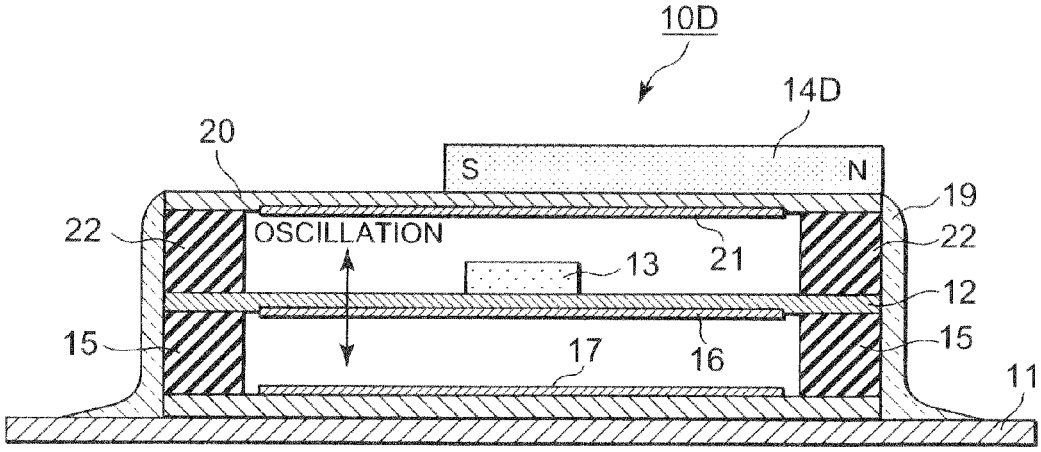
FIG. 11 is a longitudinally sectional view of a third modification of the arrangement construction of the magnet in the HEMS antenna.

FIGS. 10 and 11 are perspective view and longitudinally sectional view of a third modification of the arrangement construction of the magnet in the MEMS antenna. The cover plate 20 and the spacers 22 of FIG. 11 are omitted from the perspective view of FIG. 10. The same constituent elements as the first embodiment and the second embodiment are represented by the same reference numerals, and the description thereof is omitted.

In the MEMS antenna 10D of this modification, the permanent magnet 14D for applying the magnetic force to the magnetic member 13 of the beam 12 is not formed on the substrate 11 by the MEMS fabrication technique, but the another constituent elements are formed on the substrate 11 by the MEMS fabrication technique and fabricated as a module, and then the permanent magnet 14D is afterwards attached to the module from the outside.

For example, as shown in FIGS. 10 and 11, the beam 12 and the magnetic member 13 are covered and sealed with resin or the like, and then the permanent magnet 14D is fixed on the sealed section. One magnetic pole of the permanent magnet 14D is disposed in the neighborhood of the magnetic member 13, whereby a large amount of magnetic flux can efficiently penetrate through the magnetic member 13.

If proper magnetic force is applied to the magnetic member 13 of the beam 12, the arrangement of the permanent magnet 14D is not limited. For example, the permanent magnet may be fixed beside the beam 12, or the permanent magnet may be fixed at a place which is far away from the substrate or module in which the beam 12 is formed.

According to the above construction, the step of forming the permanent magnet 14D can be omitted from the semiconductor fabrication process of the MEMS antenna 10D, and thus the fabrication process of the MEMS antenna 10D can be simplified, Furthermore, the effect that the degree of freedom of the size, shape and arrangement of the magnet is enhanced can be obtained.

[Third Embodiment]

Figure 12A:
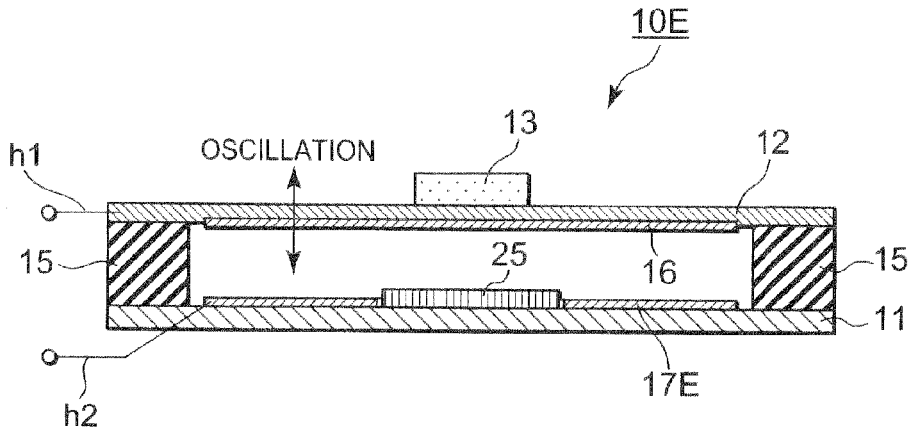
FIG. 12A is a longitudinally sectional view of a third embodiment of the MEMS antenna according to the present invention.
Figure 12B:
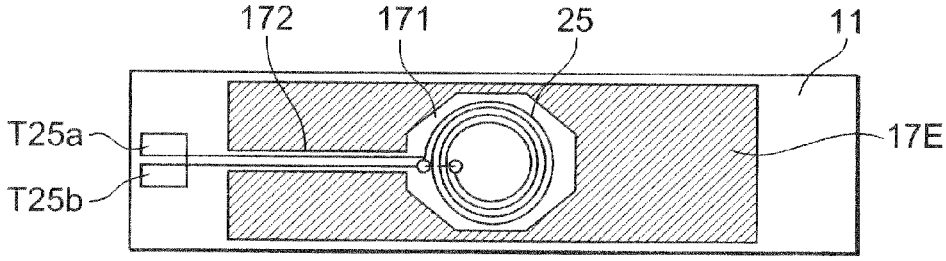
FIG. 12B is a plane view of the substrate surface of a third embodiment of the MEMS antenna according to the present invention.

FIGS. 12A and 12B show a third embodiment of the MEMS antenna according to the present invention, wherein FIG. 12A is a longitudinally sectional view and FIG. 12B is a plane view of the substrate surface.

An MEMS antenna 10E of the third embodiment adopts a coil magnet (electromagnet) 25 as an element for applying the magnetic force to the magnetic member 13 of the beam 12 in place of the permanent magnet. The other construction is the same as the first embodiment. Therefore, the same constituent elements as the first embodiment are represented by the same reference numerals, and the description thereof is omitted.

As shown in FIG. 12E, the coil magnet 25 is formed by winding a wire by a plurality of turns, and a constant electric current is made to flow through the wound wire to apply predetermined magnetic force to the magnetic member 13. In this embodiment, the coil magnet 25 is located below the magnetic member 13 on the substrate 11.

The coil magnet 25 is formed simultaneously with the electrode 17E by adding a wire pattern of the coil magnet 25 to a mask pattern in a vapor deposition step of forming the electrode 17E on the substrate 11, for example. As shown in FIG. 12E, a gap 171 is provided at the center site of the electrode 17E, and the wound wire of the coil magnet 25 is formed at this site. The inside wire of the wound wire is led out through a multilayer wire to the outside.

A slit 172 is formed to extend from the center site of the electrode 17E to one side of the electrode 17E, and lead lines extending from the wound wire of the coil magnet 25 to external terminals T25*a* and T25*b* are formed at the site of the slit 172. The slit 172 is formed on the electrode 17E as described above so that the electrode 17E is prevented from encircling the whole circumference of the wound wire of the coil magnet 25. Accordingly, when an electric current is made to flow through the coil magnet 25 or the electric current flow is stopped, an eddy current around the wound wire of the electrode 17E is avoided from occurring, and thus the coil magnet 25 is not influenced by the eddy current.

According to the MEMS antenna 10E of the third embodiment, predetermined magnetic force can be applied from the coil magnet 25 to the magnetic member 13 by making a constant electric current flow through the coil magnet when a radio wave is received. Therefore, a radio wave of a predetermined frequency band can be received by the same operation as the first embodiment.

Furthermore, according to the MEMS antenna 10E of the third embodiment, the step of forming the permanent magnet can be omitted from the semiconductor fabrication process of the MEMS antenna 10E, and thus the fabrication processing of the MEMS antenna 10E can be simplified.

Furthermore, there can be obtained an effect of varying the magnitude of the magnetic force applied from the coil magnet 25 to the magnetic member 13 of the beam 12 by adjusting an electric current to flow through the coil magnet 25.

[First Modification of Arrangement Construction of Coil Magnet]

Figure 13:
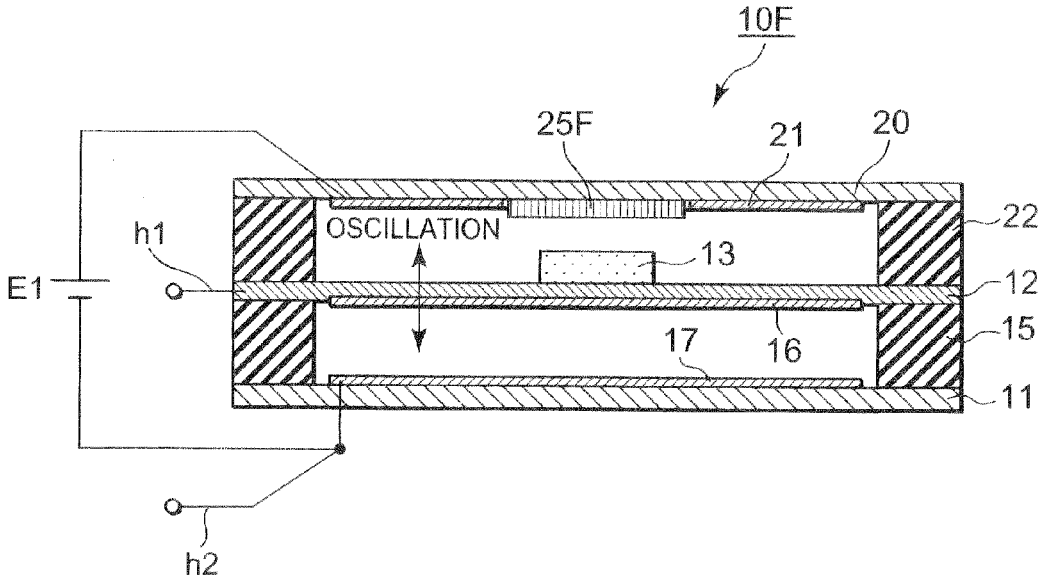
FIG. 13 is a longitudinally sectional view of a first modification of the arrangement construction of the coil magnet in the MEMS antenna.

FIG. 13 is a longitudinally sectional view of a first modification of the arrangement construction of the coil magnet in the MEMS antenna. The same constituent elements as the first to third embodiments are represented by the same reference numerals, and the description thereof is omitted.

In an MEMS antenna 10F of this modification, a coil magnet 25F is formed on the cover plate 20, and the coil magnet 25F is disposed above the beam 12 (at the opposite side to the substrate 11). In this modification, the wound wire of the coil magnet 25F and the lead lines are formed by adding the wire pattern of the coil magnet 25 to the mask pattern in the semiconductor fabrication process for forming the electrode 21 of the cover plate 20.

Even when the arrangement of the coil magnet 25F as described above is adopted, predetermined magnetic force can be applied from the coil magnet 25F to the magnetic member 13 by making a constant electric current flow through the coil magnet 25F at the reception time of the radio wave, whereby the radio wave can be received by the same action as the first to third embodiments. Furthermore, as compared with the third embodiment, the area of the electrode of the variable capacitor comprising the electrode 17 of the substrate 11 and the electrode 16 of the beam 12 can be increased, so that the large capacitance variation is generated by the displacement of the beam 12, and thus an electrical signal having large amplitude can be output.

[Second Modification of Arrangement Construction of Coil Magnet]

Figure 14:
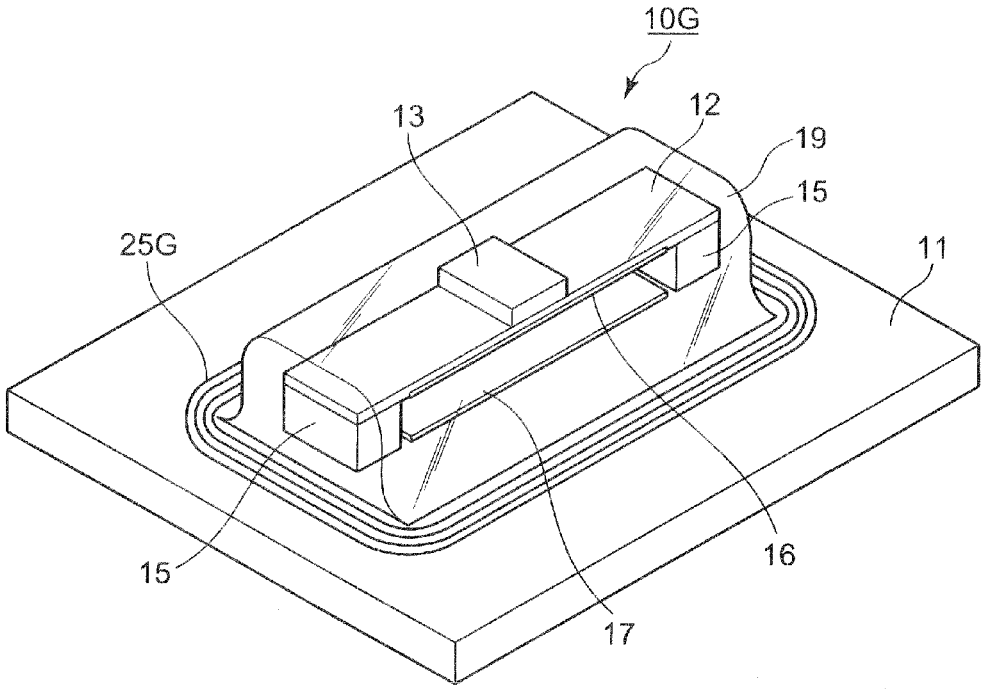
FIG. 14 is a perspective view showing a second modification of the arrangement construction of the coil magnet in the MEMS antenna.

FIG. 14 is a perspective view showing a second modification of the arrangement construction of the coil magnet in the MEMS antenna. The same constituent element, as the first embodiment are represented by the same reference numerals, and the description thereof is omitted.

In an MEMS antenna 10G of this modification, the coil magnet 25G for applying the magnetic force to the magnetic member 13 of the beam 12 is disposed around the beam Specifically, a wound wire of the coil magnet 25G is formed on the substrate 11 so as to encircle the beam 12 by using a normal semiconductor fabrication process.

Even when the coil magnet 25G as described above is adopted, predetermined magnetic force can be applied from the coil magnet 25G to the magnetic member 13 by making an electric current flow through the coil magnet 25G when a radio wave is received, whereby the radio wave can be received by the same action as the first embodiment.

As described above, according to the MEMS antennas 10, 10A to 10G of this embodiment, remarkable miniaturization, high sensitivity and enhancement of resistance to interference can be performed in the antenna.

The present invention is not limited to the above embodiments, and various modifications can be made to these embodiments. For example, in the above embodiments, the MEMS antenna is formed on the silicon substrate; however, the present invention is not limited to this style. For example, the MEMS antenna may be integrated on a glass substrate or organic material. Furthermore, the beam 12 which is designed so that both the ends thereof are supported and the center site oscillates vertically is exemplified as the oscillating body. However, a cantilever type oscillating body which is supported at one side thereof may be applied, or a tuning-fork type oscillating body may be applied.

Furthermore, in the above embodiments, the magnetic member 13 is formed at a part of the beam 12. However, the magnetic member 13 may be formed thinly over the whole part of the beam 12. The beam 12 itself may be constructed by the magnetic member. Furthermore, a magnet for applying magnetic force to the magnetic member may be omitted insofar as the MEMS antenna receives a radio wave signal having such magnitude that the beam 12 can be oscillated by only both the magnetic member and the magnetic field component of the radio wave signal.

The other detailed constructions of the above embodiments may be arbitrarily modified without departing from the subject matter of the present invention.

[Fourth Embodiment]

Figure 15:
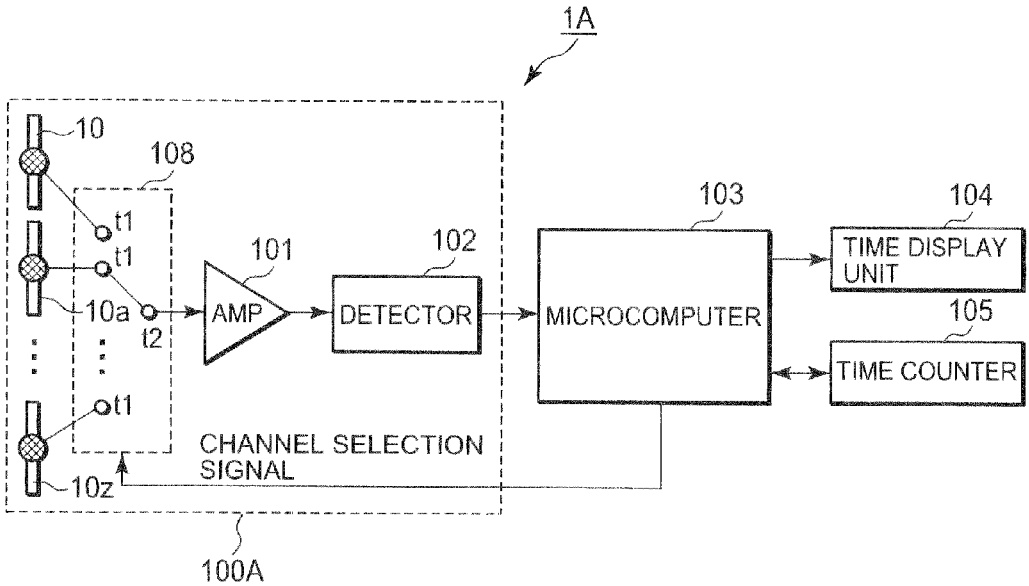
FIG. 15 is a diagram showing the overall construction of a radio wave timepiece according to a fourth embodiment of the present invention.

FIG. 15 is a diagram showing the overall construction of a radio wave timepiece according to a fourth embodiment of the present invention.

The radio wave timepiece 1A of the fourth embodiment is constructed by adding the radio wave timepiece 1 of the first embodiment shown in FIG. 1 with a plurality of the MEMS antennas 10, 10*a* to 10*z* and a switch circuit 108 which can selectively connect any one of the MEMS antennas 10, 10*a* to 10*z* to a rear stage. The same constituent elements as the first embodiments are represented by the same reference numerals, and the description thereof is omitted.

The radio wave timepiece 1A of this embodiment comprises a plurality of the MEMS antennas 10, 10*a* to 10*z* for receiving a standard radio wave modulated by a time code, the switch circuit 108 as a switch unit for selectively connecting any one of the MEMS antennas 10, 10*a* to 10*z* to rear stage, an amplifier 101 for amplifying a reception signal inputted from the MEMS antennas 10, 10*a* to 10*z* through the switch circuit 108, a detector 102 as a demodulator for extracting the time code from the reception signal, a microcomputer 103 for performing the overall control of timepiece 1A, a time display unit 104 for displaying time information, a time counter 105 for counting the time, etc. In this embodiment, a radio wave receiver 100A as a reception device is constructed by the MEMS antenna 10, 10*a* to 10*z*, the switch circuit 108, the amplifier 101 and the detector 102.

The plurality of MEMS antennas 10, 10*a* to 10Z have individually the same structure as the first to third embodiments, however, they receive radio wave signals having different frequency bands to each other. The standard radio wave is transmitted by using a carrier wave which is different in frequency band (40 kHz and 60 kHz) between a west district and an east district in Japan, for example. In foreign countries, the standard radio wave is transmitted by using a carrier wave whose frequency is different every district. Each reception frequency band of the MEMS antennas 10, 10*a* to 10*z* is matched with the frequency band of the standard radio wave of each district. In this embodiment, the antenna device is constructed by the plurality of MEMS antennas 10, 10*a* to 10*z*.

The switch circuit 108 is a switch formed by using MOS transistors or bipolar transistors, and it selectively connects any one of the plurality of output terminals t1 of the MEMS antennas 10, 10*a* to 10*z* to the input terminal t2 of the amplifier 101. The connection destination is controlled on the basis of a channel selection signal sent from the microcomputer 103.

The radio wave receiver 100A is formed on one semiconductor substrate together with the plurality of MEMS antennas 10, 10*a* to 10*z*. The radio wave receiver 100A can be formed on one semiconductor substrate together with the microcomputer 103 and the time counter 105.

First, the overall operation will be described.

The microcomputer 103 updates the output data to the time display unit 104 in synchronism with the time-count data of the time counter 105 to display the time. Furthermore, the microcomputer 103 executes the radio wave reception control program when a predetermined time comes, and activates the radio wave receiver 100A, whereby the standard radio wave transmitted with a carrier wave of a predetermined frequency band is received by the radio wave receiver 100A and the time code is detected from this reception signal. The microcomputer 103 inputs the detected time code, and determines the accurate present time from the time code. When any difference exists between the present time and the time data counted by the time counter 105, the microcomputer 103 automatically corrects this difference; therefore the accurate time is displayed at all times.

When the microcomputer 103 receives information on the present location from an operation input unit (not shown), the microcomputer 103 switches the connection of the switch circuit 108 on the basis of the information of the present location. The MEMS antennas 10, 10*a* to 10*z* have characteristics of receiving standard radio waves of different frequency bands each other. The microcomputer 103 selects one of the MEMS antennas 10, 10*a* to 10*z* which is matched with the present location, and makes the selected MEMS antenna take in the reception signal. Accordingly, the standard radio wave corresponding to the present location is received, and the time correction is executed on the basis of the time code.

Furthermore, when the reception of the time code is not confirmed through the radio wave reception processing, the microcomputer 103 also executes the following control. That is, the microcomputer 103 successively switches the connection of the switch circuit 108, searches any one of the MEMS antennas 10, 10*a* to 10*z* which can be confirmed to receive the time code, and executes the radio wave reception from the searched MEMS antenna.

In the plurality of MEMS antennas 10, 10*a* to 10*z*, the natural frequencies of the respective beams 12 are set to be different from one another, and these natural frequencies are set to be respectively identical to the frequencies of carrier waves of respective standard radio waves of different districts or different countries.

As shown in FIG. 5, the plurality of MEMS antennas 10, 10*a* to 10*z* formed in the radio wave receiver 100A are set so that the values of the specific frequencies f0 thereof are different from one another, however, the characteristics of the Q value of the reception gain thereof or the like are equivalent. Accordingly, the MEMS antennas 10, 10*a* to 10*z* are selectively switched to select an MEMS antenna which receives the radio wave, whereby a radio wave signal of a narrow frequency band of a desired channel can be taken.

Furthermore, according to the antenna device of this embodiment, the plurality of MEMS antennas 10, 10*a* to 10*z* having different reception frequency hands are provided, and thus the radio wave reception from a plurality of channels can be performed. In addition, each of the MEMS antennas 10, 10*a* to 10*z* is very small, and thus the whole chip area of the antenna device is not so large although the plurality of MEMS antennas 10, 10*a* to 10*z* are mounted there. Furthermore, all the MEMS antenna, 10, 10*a* to 10*z* can be fabricated at the same time in the same MEMS fabrication process. Accordingly, the manufacturing cost of the antenna device can be prevented from greatly increasing although the plurality of MEMS antennas 10, 10*a* to 10*z* are provided.

According to the antenna device and the radio wave receiver 100A of this embodiment, the connection between any one of the MEMS antennas 10, 10*a* to 10*z* and the rear-stage circuit (amplifier 101) is itched by the switch circuit 108. Therefore, under the situation that radio waves of a plurality of channels are transmitted, the radio wave of one of the channels can be selectively received. When radio wave signals of a plurality of channels can be received together, or the radio wave receiver is used at a place where radio wave signals of a plurality of channels are exclusively transmitted, the switch circuit 108 may be omitted.

According to the radio wave timepiece 1A of this embodiment, the radio wave receiver 100A can be designed to be extremely compact together with the MEMS antennas 10, 10*a* to 10*z*. Furthermore, the MEMS antenna 10 itself is brought with a narrow-band filter characteristic, and thus it is unnecessary to provide a narrow-band filter or the like separately, so that simplification of the circuit of the radio wave receiver 100A and reduction of the mount area can be performed. Therefore, the antenna and the reception circuit can be mounted in a small device such as a wrist watch body or the like with an extra space.

Furthermore, in the above embodiment, the MEMS antennas 10, 10*a* to 10*z* are matched with the frequency bands of the standard radio waves of the respective districts. However, the radio wave to be received is not limited to a standard radio wave containing a time code, and the antenna device and the radio wave reception device of this invention can be applied to various kinds of radio wave reception. Furthermore, in the above embodiment, the natural frequency of the beam 12 is set to be coincident with the frequency band of the reception radio wave. However, when the actual oscillating frequency of the beam is slightly different from its original natural frequency, the beam 12 may be formed to have a natural frequency reflecting this difference so that the frequency band of the reception radio wave includes the actual oscillating frequency of the beam.

Furthermore, the plurality of MEMS antennas 10, 10*a* to 10*z* may be formed to have such a characteristic that the reception frequency bands thereof are different from one another by every slight amount. In this case, a displacement of the reception frequency band of the MEMS antennas 10, 10*a* to 10*z* due to a process error, an external factor such as influence of the housing of the apparatus on a radio wave, etc. can be absorbed by properly selecting an MEMS antenna to be used from the plurality of MEMS antennas 10, 10*a* to 10*z*.

What is claimed is:

1. An antenna device comprising:

an oscillating body capable of oscillating at a predetermined natural frequency, and being displaceable by an external magnetic field; and a converter for converting motion of the oscillating body to an electrical signal, wherein when a radio wave signal of a frequency band at which the oscillating body resonates comes, the oscillating body resonates with a magnetic field component of the radio wave signal, and the converter converts the motion to the electrical signal, whereby the electrical signal corresponding to the radio wave signal is outputted.

2. The antenna device according to claim 1, further comprising a single chip substrate on which the oscillating body and the converter are formed.

3. The antenna device according to claim 1, wherein:

the oscillating body comprises a beam supported at one or a plurality of portions thereof, and a magnetic member fixed to a displaceable portion of the beam, and the antenna device further comprises a magnet for applying magnetic force to the magnetic member.

4. The antenna device according to claim 3, wherein:

the beam is fixed through a spacer to a substrate so that a longitudinal direction of the beam is along the substrate and the beam is floated from the substrate, and the magnet comprises a permanent magnet fixed on the substrate so as to face the beam.

5. The antenna device according to claim 3, wherein the magnet is attached to a module in which the oscillating body is formed after fabrication of the module.

6. The antenna device according to claim 3, wherein:

the beam is fixed through a spacer to a substrate so that a longitudinal direction of the beam is along the substrate and the beam is floated from the substrate, and the magnet comprises a coil magnet formed above, below or around the beam.

7. A reception device comprising;

the antenna device according to claim 6;

an amplifier for amplifying the electrical signal outputted from the antenna device; and a demodulator for demodulating the electrical signal amplified by the amplifier, wherein the antenna device receives a carrier wave of the frequency at which the oscillating body resonates, and the demodulator extracts an information signal from the carrier wave.

8. A reception device comprising;

the antenna device according to claim 3;

an amplifier for amplifying the electrical signal outputted from the antenna device; and a demodulator for demodulating the electrical signal amplified by the amplifier, wherein the antenna device receives a carrier wave of the frequency at which the oscillating body resonates, and the demodulator extracts an information signal from the carrier wave.

9. A reception device comprising;

the antenna device according to claim 4;

an amplifier for amplifying the electrical signal outputted from the antenna device; and a demodulator for demodulating the electrical signal amplified by the amplifier, wherein the antenna device receives a carrier wave of the frequency at which the oscillating body resonates, and the demodulator extracts an information signal from the carrier wave.

10. The antenna device according to claim 1, wherein:

the converter comprises a first electrode which is either formed on or unified with the oscillating body, and a second electrode formed so as to face the first electrode, and a capacitance of a capacitor comprising the first and second electrodes varies in accordance with a variation of an interval between the first and second electrodes, whereby an electrical signal corresponding to a variation of the capacitance is outputted.

11. A reception device comprising;

the antenna device according to claim 10;

an amplifier for amplifying the electrical signal outputted from the antenna device; and a demodulator for demodulating the electrical signal amplified by the amplifier, wherein the antenna device receives a carrier wave of the frequency at which the oscillating body resonates, and the demodulator extracts an information signal from the carrier wave.

12. The antenna device according to claim 10, wherein the converter further comprises a third electrode which is formed at an opposite side to the second electrode so as to face the first electrode, and the interval between the first and second electrodes and an interval between the first and third electrodes vary in positive and negative opposite directions to each other due to a displacement of the oscillating body, whereby the capacitance of the capacitor comprising the first and second electrodes and a capacitance of a capacitor comprising the first and third electrodes vary in the opposite directions to each other, thereby outputting an electrical signal corresponding to a variation of the capacitances.

13. A reception device comprising:

the antenna device according to claim 12;

an amplifier for amplifying the electrical signal outputted from the antenna device; and a demodulator for demodulating the electrical signal amplified by the amplifier, wherein the antenna device receives a carrier wave of the frequency at which the oscillating body resonates, and the demodulator extracts an information signal from the carrier wave.

14. The antenna device according to claim 1, further comprising:

a plurality of the oscillating bodies whose natural frequencies are different from one another; and a plurality of the converters.

15. A reception device comprising;

the antenna device according to claim 1;

an amplifier for amplifying the electrical signal outputted from the antenna device; and a demodulator for demodulating the electrical signal amplified by the amplifier, wherein the antenna device receives a carrier wave of the frequency at which the oscillating body resonates, and the demodulator extracts an information signal from the carrier wave.

16. The reception device according to claim 15, further comprising a single chip substrate on which the antenna device, the amplifier and the demodulator are formed.

17. A radio wave timepiece comprising: the reception device according to claim 15, wherein the reception device receives a standard radio wave signal and demodulates the standard radio wave signal into a time code to correct time data.

18. A reception device comprising:

the antenna device according to claim 14;

a switch unit for selectively sending the electrical signal outputted from the antenna device to a rear stage;

an amplifier for amplifying the electrical signal sent from the antenna device through the switch unit; and a demodulator for demodulating the electrical signal amplified by the amplifier.

19. The reception device according to claim 18, further comprising a single chip substrate on which the antenna device, the amplifier and the demodulator are formed.

20. A radio wave timepiece comprising:

the reception device according to claim 18, wherein the reception device receives a standard radio wave and demodulates the standard radio wave signal into a time code to correct time data.

* * * * *